US010210726B2

(12) United States Patent
Carter et al.

(10) Patent No.: US 10,210,726 B2
(45) Date of Patent: Feb. 19, 2019

(54) EVENT DETECTION SYSTEM AND METHOD OF USE

(71) Applicant: Hyperion Technology Group, Inc.

(72) Inventors: Geoffrey Ewald Carter, Saltillo, MS (US); William Garth Frazier, Tupelo, MS (US); David Ray Harris, Oxford, MS (US); Chad Matthew Williams, New Albany, MS (US); Gerald Wesley Godbold, New Albany, MS (US)

(73) Assignee: Hyperion Technology Group, Inc., Tupelo, MS (US)

( * ) Notice: Subject to any disclaimer, the term of this patent is extended or adjusted under 35 U.S.C. 154(b) by 0 days.

(21) Appl. No.: 15/765,350

(22) PCT Filed: Sep. 30, 2016

(86) PCT No.: PCT/US2016/054698
§ 371 (c)(1),
(2) Date: Apr. 2, 2018

(87) PCT Pub. No.: WO2017/059209
PCT Pub. Date: Apr. 6, 2017

(65) Prior Publication Data

US 2018/0293858 A1 Oct. 11, 2018

Related U.S. Application Data

(60) Provisional application No. 62/236,267, filed on Oct. 2, 2015.

(51) Int. Cl.

| | |
|---|---|
| ***G08B 13/16*** | (2006.01) |
| ***G08B 21/02*** | (2006.01) |
| ***H04R 3/00*** | (2006.01) |
| ***G08B 17/00*** | (2006.01) |
| ***G08B 25/00*** | (2006.01) |

(52) U.S. Cl.
CPC ..... *G08B 13/1672* (2013.01); *G08B 17/00* (2013.01); *G08B 21/02* (2013.01); *G08B 25/001* (2013.01); *H04R 3/00* (2013.01); *H04R 2430/03* (2013.01)

(58) Field of Classification Search
CPC .... G08B 13/1672; G08B 17/00; G08B 21/02; G08B 25/001; H04R 3/00
See application file for complete search history.

(56) References Cited

U.S. PATENT DOCUMENTS

| | | | |
|---|---|---|---|
| 5,504,717 | A | 4/1996 | Sharkey et al. |
| 5,703,835 | A | 12/1997 | Sharkey et al. |
| 6,847,587 | B2 | 1/2005 | Patterson et al. |
| 7,266,045 | B2 | 9/2007 | Baxter et al. |

(Continued)

FOREIGN PATENT DOCUMENTS

| | | | |
|---|---|---|---|
| WO | 2014134217 | A1 | 9/2014 |
| WO | 2014165459 | A2 | 10/2014 |

*Primary Examiner* — Leon Flores
(74) *Attorney, Agent, or Firm* — Veritay Group, IP; Susan B. Fentress

(57) ABSTRACT

This invention provides a system and method that is used to detect gunfire or explosions in an area with a sound system such as a movie, stage or theater setting, by differentiating the sounds in the presentation from those occurring in the physical location and automatically alerting authorities of the event in the movie or stage theater setting.

17 Claims, 5 Drawing Sheets

(56) References Cited

U.S. PATENT DOCUMENTS

| | | | |
|---|---|---|---|
| 7,411,865 | B2 | 8/2008 | Calhoun |
| 7,420,878 | B2 | 9/2008 | Holmes et al. |
| 7,474,589 | B2 | 1/2009 | Showen et al. |
| 7,532,542 | B2 | 5/2009 | Baxter et al. |
| 7,536,301 | B2 | 5/2009 | Jaklitsch et al. |
| 7,586,812 | B2 | 9/2009 | Baxter et al. |
| 7,599,252 | B2 | 10/2009 | Showen et al. |
| 7,602,329 | B2 | 10/2009 | Manderville et al. |
| 7,688,679 | B2 | 3/2010 | Baxter et al. |
| 7,710,275 | B2 | 5/2010 | Holmes et al. |
| 7,719,428 | B2 | 5/2010 | Fisher et al. |
| 7,750,814 | B2 | 7/2010 | Fisher et al. |
| 7,751,282 | B2 | 7/2010 | Holmes |
| 7,755,495 | B2 | 7/2010 | Baxter et al. |
| 7,796,470 | B1 | 9/2010 | Lauder et al. |
| 7,855,935 | B1 | 12/2010 | Lauder et al. |
| 7,961,550 | B2 | 6/2011 | Calhoun |
| 8,036,065 | B2 | 10/2011 | Baxter et al. |
| 8,063,773 | B2 | 11/2011 | Fisher et al. |
| 8,134,889 | B1 | 3/2012 | Showen et al. |
| 8,325,563 | B2 | 12/2012 | Calhoun et al. |
| 8,351,297 | B2 | 1/2013 | Lauder et al. |
| 8,369,184 | B2 | 2/2013 | Calhoun |
| 8,995,227 | B1 | 3/2015 | Johnson |
| 9,218,728 | B2 | 12/2015 | Bickel et al. |
| 9,613,828 | B2 | 11/2017 | Keller et al. |
| 9,813,828 | B2 | 11/2017 | Keller et al. |
| 9,886,833 | B2 | 2/2018 | Noland et al. |
| 9,896,833 | B2 | 2/2018 | Noland et al. |
| 10,054,576 | B2 | 8/2018 | Overcast |
| 10,061,013 | B2 | 8/2018 | Hermann et al. |
| 10,068,446 | B2 | 9/2018 | Brav et al. |
| 2002/0003470 | A1 | 1/2002 | Auerbach |
| 2002/0073417 | A1 | 6/2002 | Kondo et al. |
| 2003/0061344 | A1 | 3/2003 | Monroe |
| 2004/0100868 | A1 | 5/2004 | Patterson et al. |
| 2005/0237186 | A1 | 10/2005 | Fisher et al. |
| 2006/0114749 | A1 | 6/2006 | Baxter et al. |
| 2006/0161339 | A1 | 7/2006 | Holmes et al. |
| 2006/0249010 | A1 | 11/2006 | John et al. |
| 2006/0280033 | A1 | 12/2006 | Baxter et al. |
| 2008/0192574 | A1 | 8/2008 | Baxter et al. |
| 2009/0109796 | A1 | 4/2009 | Holmes et al. |
| 2014/0327543 | A1* | 11/2014 | Showen ..... G08B 17/08 340/540 |
| 2015/0131411 | A1 | 5/2015 | Gudgel et al. |
| 2016/0232774 | A1* | 8/2016 | Noland ..... G08B 13/1672 |

* cited by examiner

EVENT DETECTION SYSTEM AND METHOD OF USE

CROSS REFERENCE TO RELATED APPLICATIONS

This application is a § 371 National Stage Application of PCT/US16/54698 application filed Sep. 30, 2016, which claims the benefit of U.S. provisional patent application no. 62/236,267 filed Oct. 02, 2015 (hereby specifically incorporated herein by reference).

STATEMENT REGARDING FEDERALLY SPONSORED RESEARCH OR DEVELOPMENT

None.

REFERENCE TO SEQUENCE LISTING, A TABLE FOR A COMPUTER PROGRAM LISTING, COMPACT DISC APPENDIX

None.

BACKGROUND OF THE INVENTION

Field of the Invention

This disclosure relates to a system to determine if an audio input is a trigger event, such as a gunshot or bomb blast; to detect the location of the trigger event and if the event is deemed to be an event of interest, generate a system output that causes an external alarm notification that is silent and/or audible and/or visible to include automatic notification of law enforcement. More specifically, this invention provides a system and a method that is used to detect gunfire or explosions in a movie, stage or theater setting by differentiating the sounds in the presentation from those occurring in the physical location and automatically alerting authorities of the event in the movie, stage or theater setting.

Description of Related Art Including Information Disclosed Under 37 CFR 1.97 and 1.98

Each year people are injured or killed by gunshot or bomb blasts at public events. A need exists to provide a system and a method to differentiate the sounds of the presentation from an actual event and to alert authorities to any actual event.

BRIEF SUMMARY OF THE INVENTION

This invention provides a system for generating an alert for a trigger event in a movie or stage theater setting including the elements of: at least one acoustic sensor unit configured to detect an audio signal of an event within the area; a central processing unit configured to receive an output from the least one sensor and the audio system, wherein the central processor is configured to determine differential audio data by subtracting a presentation audio signal from the area audio signal, and wherein the central data processing unit is configured to determine if the signal corresponding to the audio signal of an event within the area is a false event or is a trigger event; and a system output that causes an external alarm notification, if a trigger event is detected in the area. This invention can additionally provide an auxiliary input to trigger an alert condition by a user or other non-acoustic source. This invention can additionally provide an auxiliary input to cancel an alert in the event of a false alarm. This invention can additionally provide an auxiliary output to trigger an external alarm system to include as: lights, horns and/or sirens.

Another aspect of the inventive subject matter is a method to detect an event in an area having an audio system wherein a presentation is occurring in the area using the audio system; involving the steps of: positioning a plurality of spaced apart acoustic sensor units in the area to detect an area audio signal; detecting a presentation audio signal from an output of the audio system; receiving the area audio signal and the presentation audio signal at a central processor; determining a differential audio data by subtracting the presentation audio signal from the area audio signal; and computing if an event is occurring in the area by analyzing the differential audio data for temporal and frequency spectrum content characteristics of the event, wherein the event is a gunshot or an explosion in the area.

BRIEF DESCRIPTION OF SEVERAL VIEWS OF THE DRAWING(S)

The invention can be best understood by those having ordinary skill in the art by reference to the following detailed description when considered in conjunction with the accompanying drawings in which.

DETAILED DESCRIPTION OF THE INVENTION

The present invention may be understood more readily by reference to the following detailed description of the invention. It is to be understood that this invention is not limited to the specific devices, methods, conditions or parameters described herein, and that the terminology used herein is for the purpose of describing particular embodiments by way of example only and is not intended to be limiting of the claimed invention. Also, as used in the specification containing the appended claims, the singular forms "a," "an," and "the" include the plural, and reference to a particular numerical value includes at least that particular value, unless the context clearly dictates otherwise. Ranges may be expressed herein as from "about" or "approximately" one particular value and/or to "about" or "approximately" another particular value.

Figure 1:
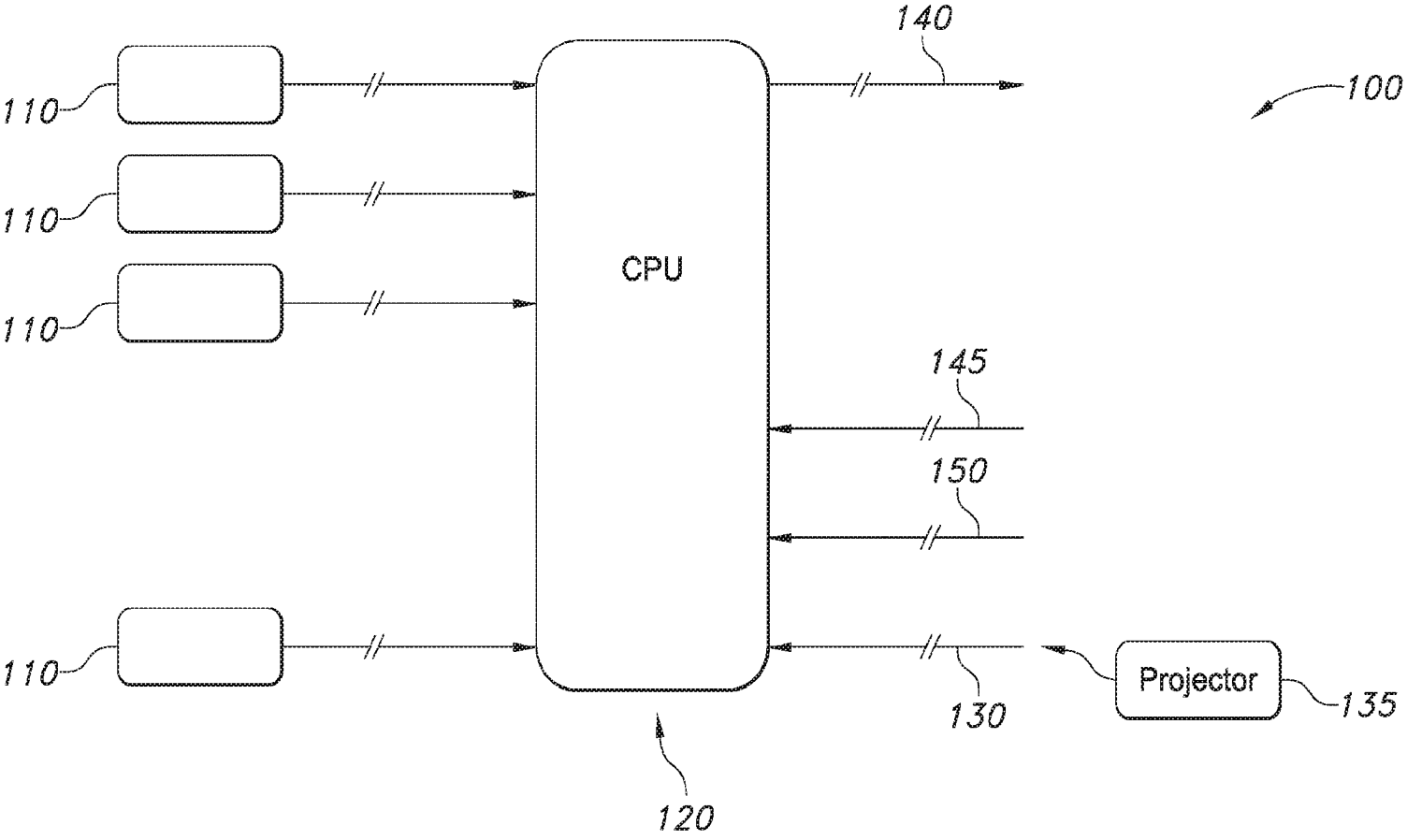
FIG. 1 illustrates an exemplary embodiment of the active event detection system.
Figure 2:
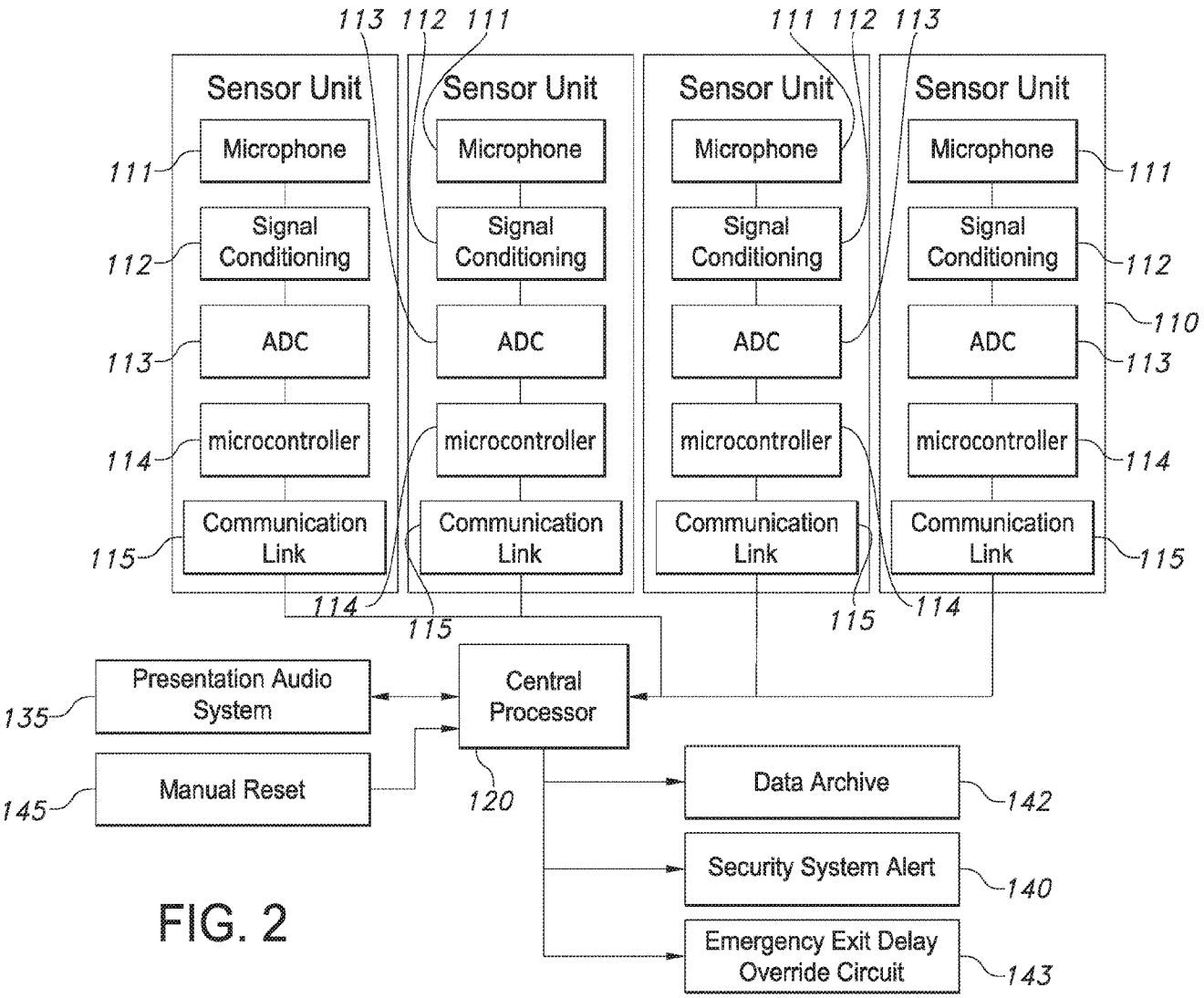
FIG. 2 illustrates a more detailed exemplary embodiment of the active event detection system.

Referring to FIGS. 1 and 2, an illustrative embodiment is provided showing the system 100 of the present invention. This invention provides a system 100 that is used to detect an event, such as gunfire or explosions in a movie, stage, or theater setting. The system 100 can automatically alert authorities of an event in a movie, stage, or theater setting. The system 100 uses the audio feed from the presentation to reduce the chance of false positive alerts. The system 100 includes one or more acoustic sensor units 110, such as microphones, that are located at locations throughout the room or facility in which the presentation or presentations are being provided. The exact number and locations of the acoustic sensor units 110 is determined by one skilled in the art with the purpose of providing sufficient gunshot or explosion detection capability. An acoustic sensor unit 110, in an exemplary embodiment, is made of a microphone 111, such as a high sound pressure level electret microphone. An electret microphone is a type of electrostatic capacitor-based microphone, which eliminates the need for a polarizing power supply by using a permanently charged material. The out-put of the microphone 111, is provided to a signal conditioning unit 112 to manipulate an analog signal in such a way that it meets the requirements of the next stage for further processing. The signal conditioning unit 112, in one exemplary embodiment is based on a fully differential operational amplifier design. The output of the signal conditioning unit 112 is provided to a digital converter 113, such as a high bit-depth audio frequency Sigma-Delta analog to digital converter. The output of the digital converter 113 is provided to a microcontroller 114.

In an exemplary embodiment, the microcontroller 114 is a 32-bit microcontroller with digital signal processing libraries and an Ethernet interface. A wired or wireless communication link 115 is provided to a central process unit 120. The central processing unit 120 in an exemplary embodiment, is made of a rack mount computer with an Ethernet switch or router to allow communications with the acoustic sensor units 110 as well as the interface hardware to allow interfacing with any other external devices deemed necessary. The electrical signals from the acoustic sensor units 110 are transmitted to a central data processing unit 120 via wired or wireless communications channels. The central data processing unit 120 is configured to receive an electronic transmission from the presentation of an audio system 135, where they are compared with one another and with an auxiliary input of signals corresponding to those input to the presentation's sound amplification system 130. The signal conditioning circuit interfaces with an audio frequency Sigma-Delta analog to digital converter 113. The data from the analog to digital converter 113 is read using a 32-bit microcontroller with digital signal processing libraries and an Ethernet interface. The Ethernet interface is used to transfer data from the discrete acoustic sensor units 110 to a central processing unit 120 via a wired or wireless communication link. In an exemplary embodiment, the one or more acoustic sensor units 110 are omnidirectional and each include a digitizing unit that continuously converts samples of the electrical signals of the microphone into data that can be transmitted to the data processing unit 120 along with data indicating the position of each unit 110. The acoustic sensor units 110 directly provide digitized outputs and accurately represent signals of very high sound pressure levels. Using data received from the acoustic sensor units 110, the central processing unit 120 analyzes the data for precise time of arrival at each of the acoustic sensor units 110 in order to determine the location of the event within the room or facility. The measured waveforms corresponding to these events are analyzed for proper content and amplitude to determine if they are an event of interest or not. Those events not meeting predetermined criteria are deemed false and are ignored. An auxiliary audio input 130 is used to reduce false alarms created by gunshot or explosive events that are part of the presentation by comparison with signals from the independently measured acoustic sensor units 110. Only those acoustic sensor units 110 measurement events that are not part of the presentation are analyzed to determine the likelihood of the event being a gunfire or explosion.

In an exemplary embodiment, an auxiliary audio input 130 from the output of the projector and/or sound amplification system 135 is provided to eliminate false alarms from the movie or presentation. More specifically, the locations of the speakers or general locations of the sounds, such as in a performance, are utilized to minimize false alarms. In one embodiment, the digitized signal from the output of the projector and/or sound amplification system 135 creates a digitized indicator of position of an event and the CPU 120 compares the location of the event with the known locations of the speakers or performance sound, and makes the decision that the potential event is in fact part of the performance and therefore is not reported. Those events deemed to be events of interest generate a system output 140 that triggers external alarm notifications that are silent and/or audible and/or visible to include automatic notification of law enforcement.

The system 100 possess an auxiliary input to cancel an alarm 145 via user action using remote wired or wireless control should an automatic trigger be deemed a false alarm or if a previous user-initiated alarm is to be cancelled. The system 100 possess an auxiliary input to cancel an alarm 145 via user action using remote wired or wireless control should an automatic trigger be deemed a false alarm or if a previous user-initiated alarm is to be cancelled.

The system can provide an auxiliary input to trigger an alarm via human action 150 using remote wired or wireless controls at any time deemed necessary.

The system 100 can archive data 142. Alternately, the system 100 can provide an emergency exit delay override circuit 143.

Figure 3:
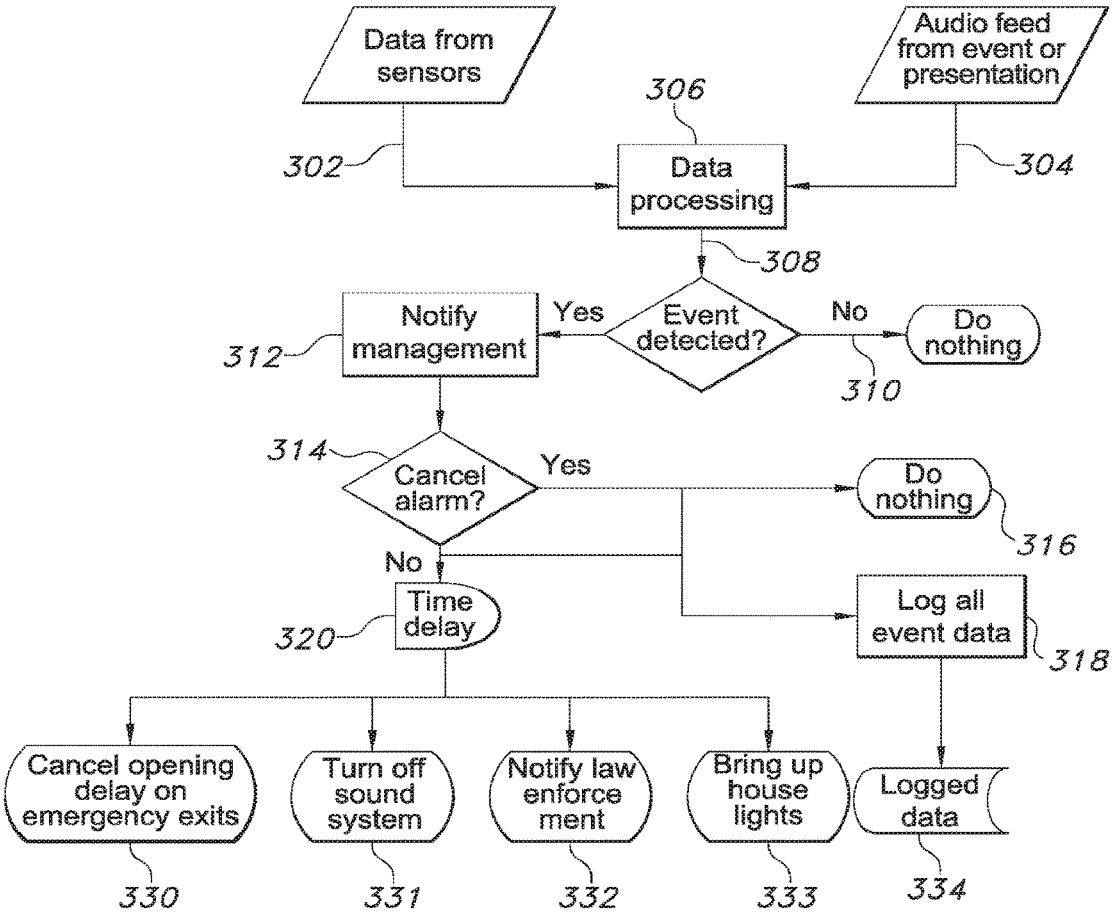
FIG. 3 illustrates the flow of data in an exemplary embodiment of the active event detection system.

Now referring to FIG. 3, the flow of data is shown. This data flow illustrates a method to detect an event in an area with an audio system wherein a presentation is occurring in this area. The area can include for example a movie theater, stage, gymnasium or café. The method includes the steps of: positioning a plurality of spaced apart sensor units in the area to detect area audio data. The data from the plurality of spaced apart sensor units are electronically transmitted 302 to a central processing unit for data processing 306. Another step of the process involves analyzing the audio data from an output of the audio system. The audio data from an output of the audio system is electronically transmitted 304 to the central processing unit for data processing 306. The process further involves the step of determining differential audio data by subtracting the audio data from the output of the audio system from the area audio data; and computing if an event is occurring in the area by analyzing the differential audio data for temporal and frequency spectrum content characteristics of the event, wherein the event is a gunshot or an explosion. The data is analyzed according to several criteria in order to make a decision as to issuing an alarm or not. The table below summarizes the criteria used for determination. Collectively, these criteria ensure that the sound is a loud enough transient to be a gunshot and that it also possesses temporal and frequency spectrum content characteristics that are indicative of gunshots or explosions

| | Criteria for alarm (all must be satisfied) | | | |
|---|---|---|---|---|
| | Acoustic amplitude estimate at 1 meter from source | Positive pulse duration (msec) over all sensor measurements | Acoustic frequency spectrum estimated from sensor measurements | Location estimate of transient acoustic event |
| Threshold | Must exceed a specified threshold | Must be within a specified range of values | Must have a peak amplitude between a specified range of frequencies | Must be within a specified perimeter to be defined by the application |

If the output of the central processing unit is a determination that an event is detected, such as a shot or an explosion 308, then either two of events can occur: a directive to do nothing 310 or a directive to notify management 312. In one illustrative embodiment, if the directive to notify management 312 occurs then, management is queried to cancel the alarm 314, if yes, the directive is to do nothing 316 and the event data is logged 318. If no, 320 then a number of actions can occur: including: cancel opening delay on emergency exits 330, turn off the sound system 331, notify law enforcement 332, bring up the area lights 333, and the event data is logged 334.

Figure 4:
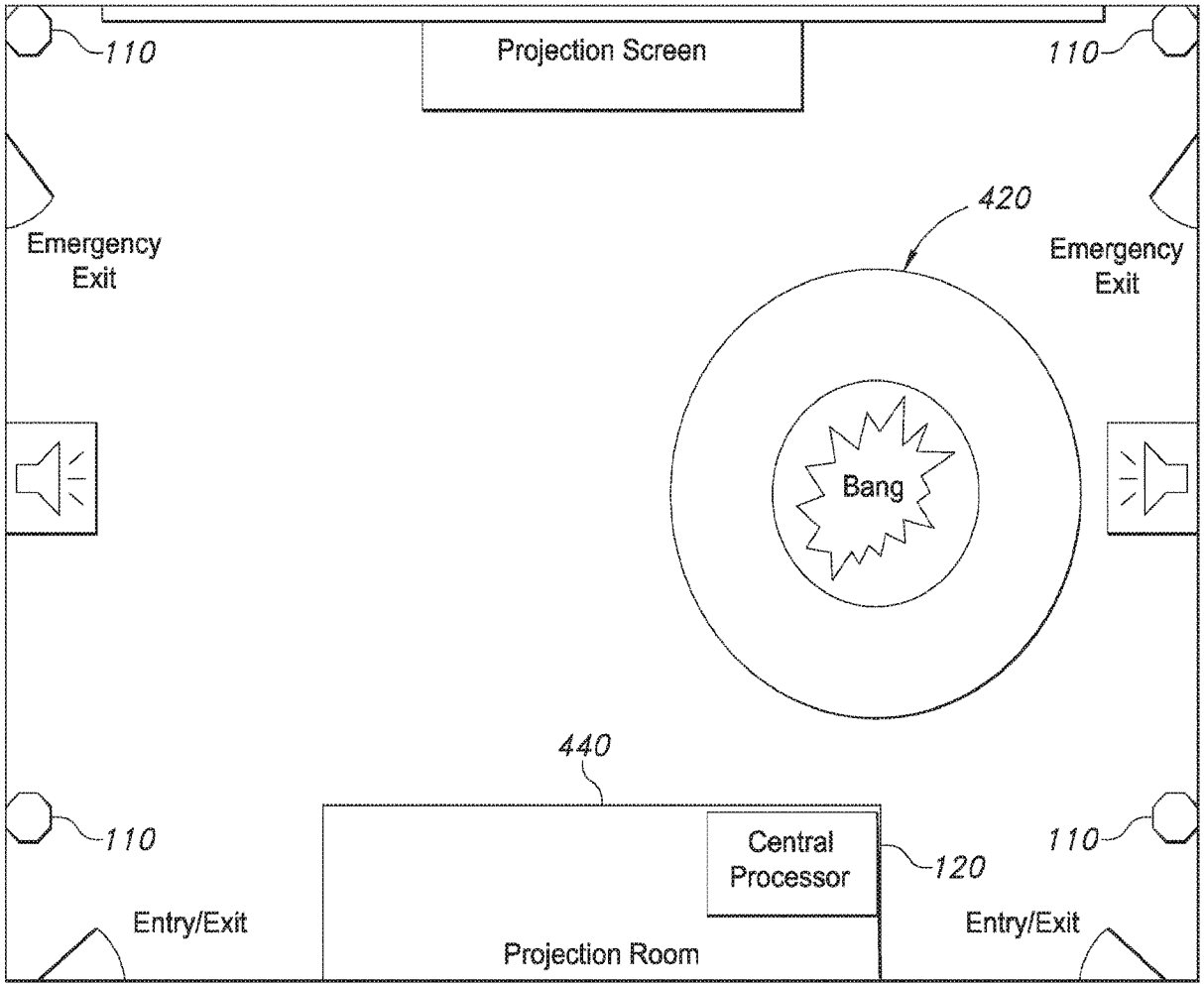
FIG. 4 is a schematic diagram of one exemplary embodiment of the active event detection system.
Figure 5:
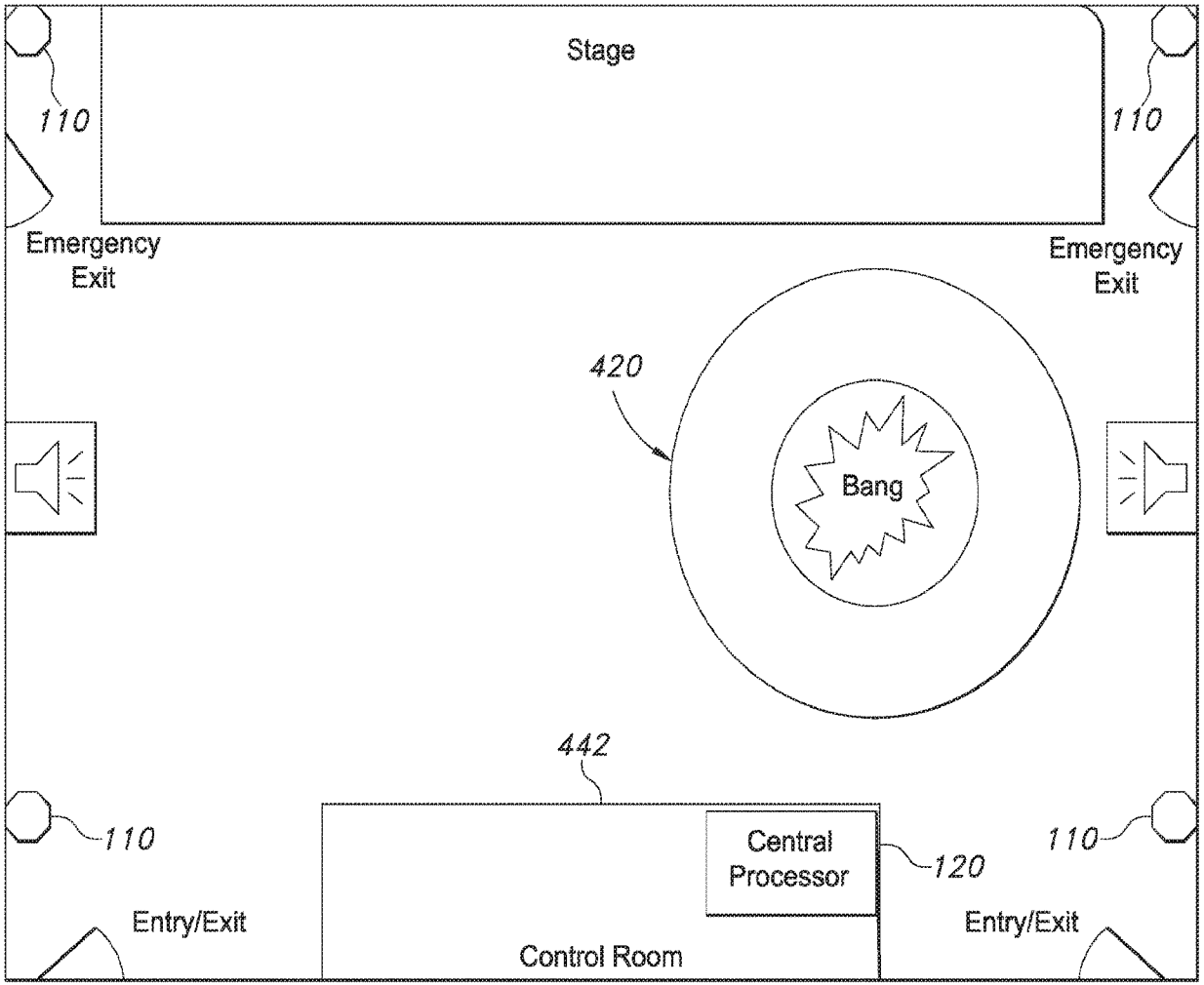
FIG. 5 is a schematic diagram of one exemplary embodiment of the active event detection system.

Now referring to FIGS. 4 and 5 exemplary embodiment of either a movie theater or a live stage presentation is shown. The placement of the one or more sensors 110 is shown. The event 420 that produced audio data for temporal and frequency spectrum content characteristics of an event, consistent with a gunshot or explosion is detected by the one or more acoustic sensor units 110. A central processing unit 120 is located in the projection room 440 or central room 442 receives data from the sensor 302 and receives an audio feed from an event or presentation 304. The data are processed to eliminate the audio feed from the event or presentation. If an event is detected management is notified 312. In this case a number of actions can occur, such as, cancel opening delay or emergency exits 330, turn off sound system 331, notify law enforcement 331, bring up the area lights 333, and log data 334 to data storage device.

Equivalent elements can be substituted for the ones set forth above such that they perform in substantially the same manner in substantially the same way for achieving substantially the same result. It is believed that the system and method of the present invention and many of its attendant advantages will be understood by the foregoing description. It is also believed that it will be apparent that various changes may be made in the form, construction and arrangement of the components thereof without departing from the scope and spirit of the invention or without sacrificing all of its material advantages. The form herein before described being merely exemplary and explanatory embodiment thereof. It is the intention of the following claims to encompass and include such changes.

The invention claimed is:

1. method to detect an event in an area having a broadcasting audio system, wherein a presentation is occurring in the area using the broadcasting audio system; comprising the steps of:

positioning a plurality of spaced apart acoustic sensor units in the area to provide an area audio signal;

receiving a presentation audio signal directly from an output of the broadcasting audio system at a central processor;

separately receiving the area audio signal and the presentation audio signal at the central processor;

determining a differential audio data by subtracting the presentation audio signal from the area audio signal; and computing if an event is occurring in the area by analyzing the differential audio data for temporal and frequency spectrum content characteristics of the event, wherein the event is a gunshot or an explosion in the area, wherein the area is selected from the group consisting of: movie, stage and theater.

2. The method of claim 1 further comprising the step of notifying a mar management entity Of the event occurring in said area and creating an alarm.

3. The method of claim 2 further comprising the step of cancelling the alarm.

4. The method of claim 2 further comprising the step of cancelling the opening delay of an emergency exit in the area.

5. The method of claim 2 further comprising the step of turning off a sound system in the area.

6. The method of claim 2 further comprising tine step of n notifying law enforcement.

7. The method of claim 2 further comprising the tile step of bringing up lights in the area.

8. The method of claim 1 further comprising the step of logging data related to the event into a data storage system.

9. The method of claim 1 further comprising the step of notifying law enforcement.

10. The method of claim 1 further comprising creating a digitized indicator of a position of the event.

11. The method of claim 1 further comprising the step of deterring a precise time of an arrival of a sound at each of the acoustic sensor units in order to determine the location of the event within the area.

12. A system for generating an alert for an vent in an area with a broadcasting audio system comprising:

at least one acoustic sensor unit configured to detect n audio signal of an event within the area;

the broadcasting audio system;

a central processing unit configured to receive an output from the least one sensor and an output from the audio system, wherein the central processor is configured to compute if the event is occurring in the area by analyzing the differential audio data for temporal and frequency spectrum content characteristics of the event, wherein the event is a gunshot or an explosion in the area and wherein the central data processing unit is configured to determine if the signal corresponding to the audio signal of an event within the area is a false event or is a trigger event; and a system output that causes an external alarm notification, if a trigger event is detected in the area wherein the area is selected from the group consisting of; movie, stage and theater.

13. The system of claim 12 wherein said audio system is configured to create a digitized indicator of a position of the event.

14. The system of claim 12 further comprising a system output to trigger an external alarm notification.

15. The system of claim 12 further comprising an auxiliary input to cancel an alarm via a user action using a remote wired or wireless control if the, alarm is a false alarm.

16. The system of claim 12 further comprising an auxiliary input to trigger an alarm via human action.

17. The system of claim 12 wherein the at least one acoustic sensor unit is comprised of a high sound pressure level electret microphone.

* * * * *